US009227449B2

(12) United States Patent
Yuno

(10) Patent No.: US 9,227,449 B2
(45) Date of Patent: Jan. 5, 2016

(54) STAMP FACE FORMING APPARATUS, STAMP FACE FORMING METHOD, AND NON-TRANSITORY COMPUTER-READABLE RECORDING MEDIUM

(71) Applicant: CASIO COMPUTER CO., LTD., Shibuya-ku, Tokyo (JP)

(72) Inventor: Hirotaka Yuno, Hiratsuka (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/534,040

(22) Filed: Nov. 5, 2014

(65) Prior Publication Data

US 2015/0124038 A1 May 7, 2015

(30) Foreign Application Priority Data

Nov. 5, 2013 (JP) ..... 2013-229178

(51) Int. Cl.
*B41J 2/315* (2006.01)
*B41J 2/32* (2006.01)
*B41K 1/00* (2006.01)

(52) U.S. Cl.
CPC . *B41K 1/00* (2013.01); *B41J 2/315* (2013.01); *B41J 2/32* (2013.01)

(58) Field of Classification Search
USPC ..... 347/171; 101/128.4; 400/120.01
See application file for complete search history.

(56) References Cited

U.S. PATENT DOCUMENTS 4,738,553 A * 4/1988 Uemura et al. ..... 400/120.05
5,253,581 A * 10/1993 Miki et al. ..... 101/121
5,582,105 A * 12/1996 Miki et al. ..... 101/128.4
6,276,272 B1 * 8/2001 Takami et al. ..... 101/401.1

FOREIGN PATENT DOCUMENTS

JP 61-64480 * 4/1986 ..... 347/180
JP 4-242776 * 8/1992 ..... G03G 15/20
JP 10044487 A 2/1998
JP 10100464 A 4/1998
JP 11235838 A 8/1999
JP 2009208294 A 9/2009

OTHER PUBLICATIONS

Computer-generated translation of JP 10-044487, published on Feb. 1998.*
Computer-generated translation of JP 11-235838, published on Aug. 1999.*
Japanese Office Action (and English translation thereof) dated Sep. 29, 2015, issued in counterpart Japanese Application No. 2013-229178.

* cited by examiner

*Primary Examiner* — Huan Tran
(74) *Attorney, Agent, or Firm* — Holtz, Holtz, Goodman & Chick PC

(57) ABSTRACT

A stamp face forming apparatus includes: a stamp face forming unit having a plurality of heating elements arranged in a direction along a surface on which a porous stamp face material being able to become nonporous by heating is held, and a drive circuit for controlling the heating states of the plurality of heating elements, the stamp face forming unit being configured to form a stamp face on the stamp face material while pressing the stamp face material; and a control unit configured to control the drive circuit of the stamp face forming unit in such a manner as to reduce the heating amount per one dot to be heated of the stamp face material in the arrangement direction of the plurality of heating elements corresponding to a decreasing length of the stamp face material in the arrangement direction of the plurality of heating elements.

24 Claims, 9 Drawing Sheets

| WIDTH OF SEAL FACE MATERIAL | 15mm | 30mm | 45mm |
|---|---|---|---|
| PRESSURE | 1225g/cm | 612g/cm | 408g/cm |
| CRUSHED AMOUNT | 0.5mm | 0.45mm | 0.3mm |
| OFFSET VALUE | 1000μsec | 500μsec | – |

FIG. 9A
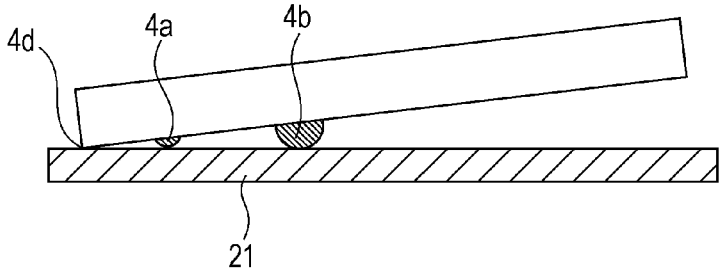
FIG. 9B
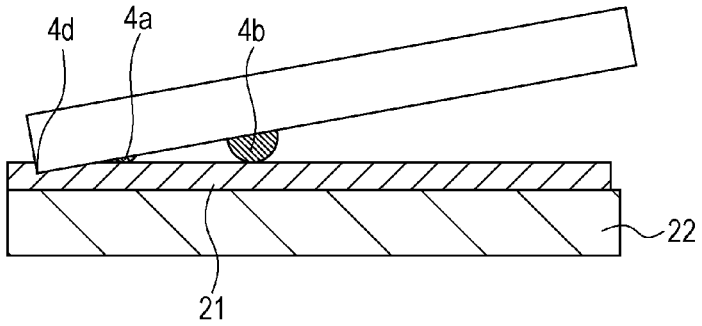
FIG. 10
| WIDTH OF SEAL FACE MATERIAL | 15mm | 30mm | 45mm |
|---|---|---|---|
| PRESSURE | 1225g/cm | 612g/cm | 408g/cm |
| CRUSHED AMOUNT | 0.5mm | 0.45mm | 0.3mm |
| OFFSET VALUE | 1000μsec | 500μsec | – |

STAMP FACE FORMING APPARATUS, STAMP FACE FORMING METHOD, AND NON-TRANSITORY COMPUTER-READABLE RECORDING MEDIUM

CROSS-REFERENCE TO RELATED APPLICATIONS

This application is based upon and claims the benefit of priority from the prior Japanese Patent Application No. 2013-229178, filed Nov. 5, 2013, the entire contents of which are incorporated herein by reference.

BACKGROUND OF THE INVENTION

1. Field of the Invention

The present invention relates to a stamp face forming apparatus, a stamp face forming method, and a non-transitory computer-readable recording medium storing a program for causing a computer to execute a stamp face forming process.

2. Description of the Related Art

A stamp is conventionally known which uses a porous sheet such as sponge rubber as a stamp face material and impregnates the sheet in advance with ink to save time and trouble to attach ink to the stamp face of the stamp whenever affixing the stamp.

For example, a stamp face making apparatus is proposed in Japanese Patent Application Laid-open No. 10-100464, which fixes, onto the making apparatus, a stamp whose stamp plate (stamp face material) made of a porous sheet is attached to a block, moves a thermal head while pressing the thermal head against the surface of the porous sheet, selectively heats heating elements of the thermal head, and makes, on the stamp plate, a stamp face including melted and solidified portions that do not allow the ink to pass through and non-melted portions that allow the ink to pass through.

The stamp surface making apparatus of Japanese Patent Application Laid-open No. 10-100464 fixes the stamp face material attached to the block, and needs to use an edge head being an expensive component. The stamp face making apparatus as a whole is in a large size. For reasons including the above, it is difficult to reduce its manufacturing costs.

SUMMARY OF THE INVENTION

An aspect of a stamp face forming apparatus according to the present invention includes:

a stamp face forming unit including a plurality of heating elements arranged in a direction along a surface on which a porous stamp face material being able to become non-porous by heating is held, and a drive circuit for controlling the heating states of the plurality of heating elements, the stamp face forming unit being configured to form a stamp face on the stamp face material while pressing the stamp face material; and a control unit configured to control the drive circuit of the stamp face forming unit in such a manner as to reduce a heating amount per one dot to be heated of the stamp face material in the arrangement direction of the plurality of heating elements corresponding to a decreasing length of the stamp face material in the arrangement direction of the plurality of heating elements.

Further, an aspect of a stamp face forming method includes the stamp face forming step of, upon forming a stamp face on a porous stamp face material being able to become non-porous by heating, using a plurality of heating elements arranged in a direction along a surface on which the stamp face material is held, and a drive circuit for controlling the heating states of the plurality of heating elements, while moving the stamp face material relatively to a stamp face forming unit for applying heat to the stamp face material to form the stamp face, controlling the drive circuit of the stamp face forming unit in such a manner as to reduce a heating amount per one dot to be heated of the stamp face material in the arrangement direction of the plurality of heating elements corresponding to a decreasing length of the stamp face material in the arrangement direction of the plurality of heating elements.

Moreover, an aspect of a non-transitory computer-readable recording medium storing a program for causing a computer to execute a stamp face forming process of, upon forming a stamp face on a porous stamp face material being able to become non-porous by heating, using a plurality of heating elements arranged in a direction along a surface on which the stamp face material is held, and a drive circuit for controlling the heating states of the plurality of heating elements, while moving the stamp face material relatively to a stamp face forming unit for applying heat to the stamp face material to form the stamp face, controlling the drive circuit of the stamp face forming unit in such a manner as to reduce a heating amount per one dot to be heated of the stamp face material in the arrangement direction of the plurality of heating elements corresponding to a decreasing length of the stamp face material in the arrangement direction of the plurality of heating elements.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 9A is a conceptual diagram illustrating the state of contact between a print target and a heating element in a case where the stamp face material of the print target is hard;

FIG. 9B is a conceptual diagram illustrating the state of contact between a print target and the heating element in a case where the stamp face material of the print target is EVA; and FIG. 10 is a diagram illustrating the relationship between the width of the stamp face material, a pressure, a crushed amount, and an offset value.

DETAILED DESCRIPTION OF THE INVENTION

<<Definitions of Concepts and Terms>>

Figure 1A:
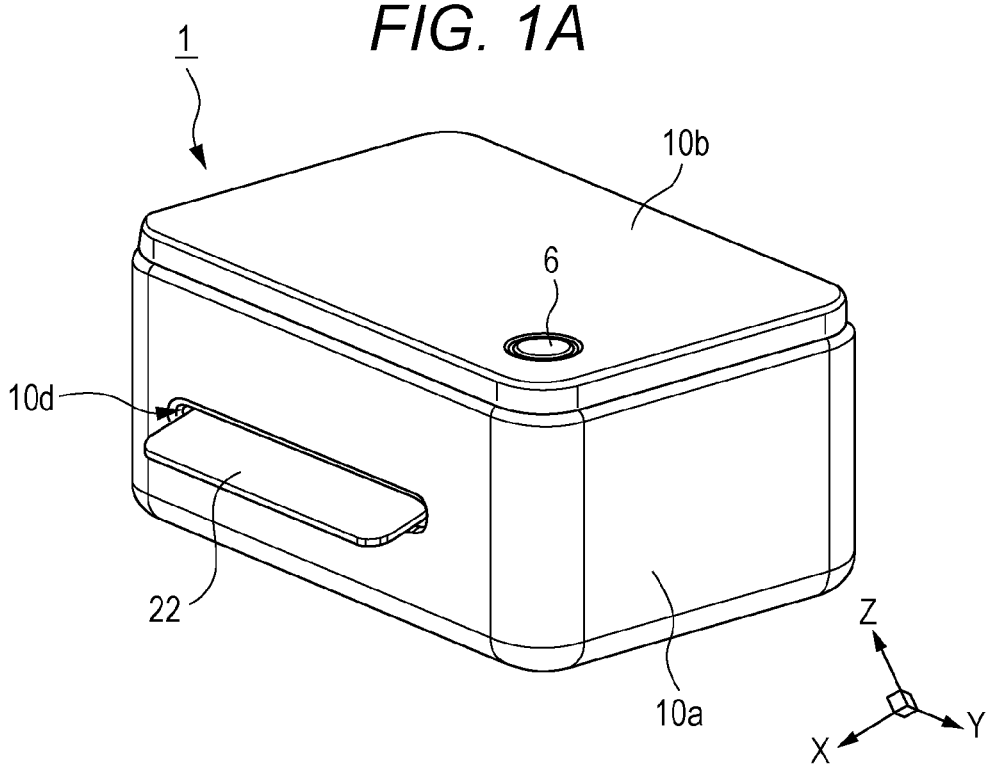
FIG. 1A is an external perspective view illustrating a stamp face forming apparatus according to one embodiment of the invention, together with a stamp face material holder.

Hereinafter, important concepts and terms are defined before giving a description of an embodiment of the invention.

A stamp face forming apparatus is an apparatus that forms a pattern on a stamp face material. In the invention, what is called a thermal printer can be used. The thermal printer includes a thermal head, and can selectively heat a plurality of heating elements by a drive circuit (driver) that drives the plurality of heating elements. Moreover, the thermal head includes a temperature sensor (thermistor) in a vicinity thereof, measures the environmental temperature (the temperature that rises due mainly to the heat generated by the thermal head), and provides information on the environmental temperature to a control unit described below. The control unit controls the drive circuit based on the information.

A stamp face material is a thermoplastic member made of a porous sponge body that can impregnate liquid ink, which becomes non-porous by heating. For example, a porous ethylene vinyl acetate copolymer (EVA) can be used.

A stamp face material holder is a tool used to pass the stamp face material through the stamp face forming apparatus in order to form a pattern on the stamp face material. For example, the stamp face material holder holding the stamp face material is supplied to a user of the stamp face forming apparatus. In the specification, for the sake of convenience, the stamp face material holder is assumed to include the stamp face material and a holding body that holds the stamp face material.

The holding body is a member that includes, for example, a paperboard made of coated board, and is disposed of after the stamp face material is removed from the stamp face material holder subsequent to the formation of the stamp face.

A stamp face forming unit is a mechanical part that performs a process of selectively applying heat with the thermal head to make areas on the surface of the stamp face material non-porous, and prohibiting the passage of the ink through the areas.

Printing (printing by the thermal printer) is not printing with ink, but indicates performing a process of making/not making the surface of the stamp face material non-porous on a dot-by-dot basis, the dot being in a predetermined size (the size of the heating element of the thermal head), by selectively heating the heating elements of the thermal head according to image data.

A current-carrying signal is a signal to be provided to the drive circuit of the thermal head, and is a signal to apply power to cause the thermal head to generate heat.

A current-carrying table is a table to be referred to by the control unit to set a current-carrying time, and is used, for example, to decide the length of the current-carrying time to energize the thermal head in association with the environmental temperature measured by the thermistor provided in the vicinity of the thermal head.

Print data is data for forming, on the stamp face material, a stamp face desired by a user who is attempting to form the stamp face. Note that printing by the thermal head is the process of prohibiting the passage of the ink. The print data is image data in which white and black, and left and right are reversed when viewed from an impression impressed with the stamp face made by the user.

A conveying unit is a mechanical part that conveys the stamp face material holder, and can be configured of, for example, a platen roller and a stepping motor that moves the platen roller.

The control unit is a control unit (CPU) of the stamp face forming apparatus. The control unit of the stamp face forming apparatus is connected to a personal computer (PC), a smartphone, a tablet computer, or the like by wired communication (USB (registered trademark) or wireless communication (Wi-Fi (registered trademark), Bluetooth (registered trademark), WLAN (registered trademark), or the like) and accordingly can function in a coordinated fashion.

The holding of the stamp face material is performed at a factory that manufactures the stamp face material holder when the stamp face material is supplied to the user in a state of being held by the stamp face material holder.

A stamp face forming step is a step to be performed when the user of the stamp face forming apparatus uses the stamp face material holder to form the stamp face.

<<Regarding Core of the Invention>>

As described above, an issue of the invention is to provide a stamp face forming apparatus, a stamp face forming method, and a non-transitory computer-readable recording medium storing a program for causing a computer to execute a stamp face forming process. Most of all, in that case, the invention is for controlling a heating amount depending on the difference of the width of the stamp face material.

Hereinafter, the stamp face forming apparatus according to the invention is described in detail with reference to the drawings.

<<The Mechanical Configuration of the Stamp Face Forming Apparatus (Thermal Printer) is Described with Reference to FIGS. 1A, 1B, 2A, 2B, 3, 4A, and 4B>>

Figure 1B:
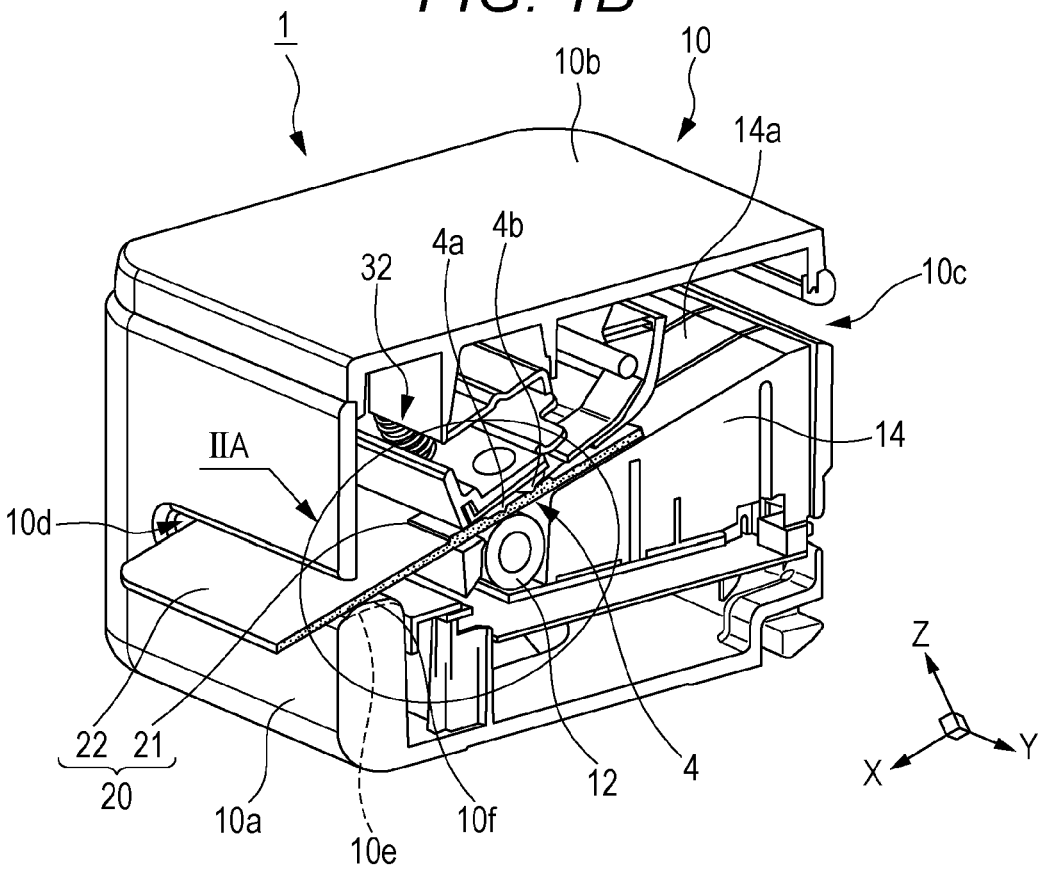
FIG. 1B is a perspective view depicting the stamp face forming apparatus according to the embodiment of the invention, cutting the stamp face forming apparatus at a vertical plane along a conveying direction.
Figure 2A:
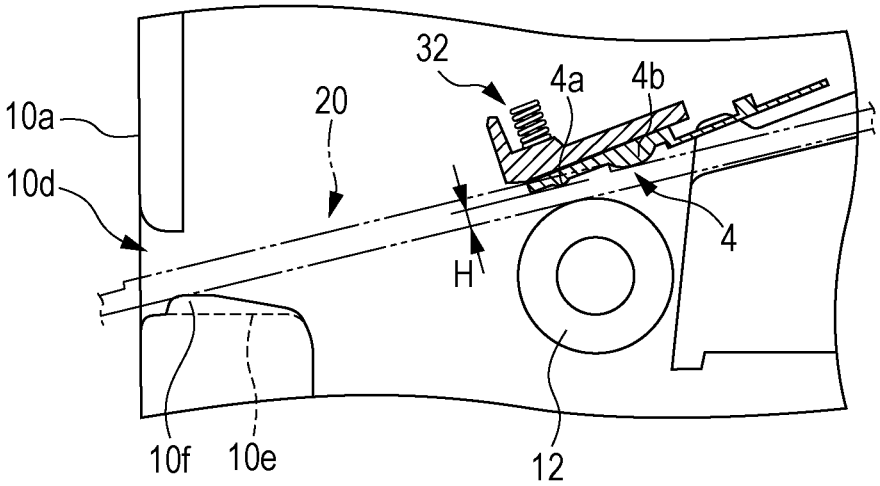
FIG. 2A is a cross-sectional view illustrating a structure in the vicinity of an ejection port of the stamp face material holder, which is of the stamp face forming apparatus according to the embodiment.
Figure 2B:
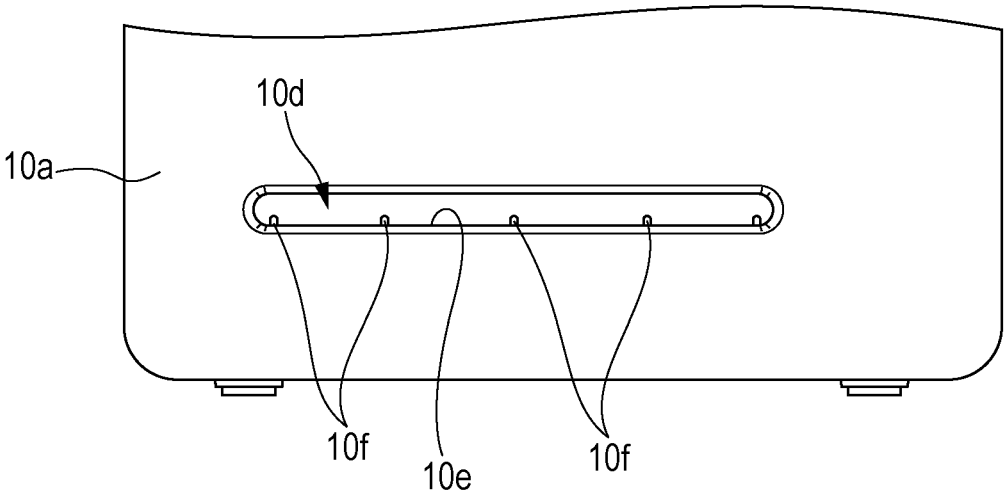
FIG. 2B is an enlarged external view when viewing the ejection port of the stamp face material holder, which is of the stamp face forming apparatus according to the embodiment from the front.
Figure 3:
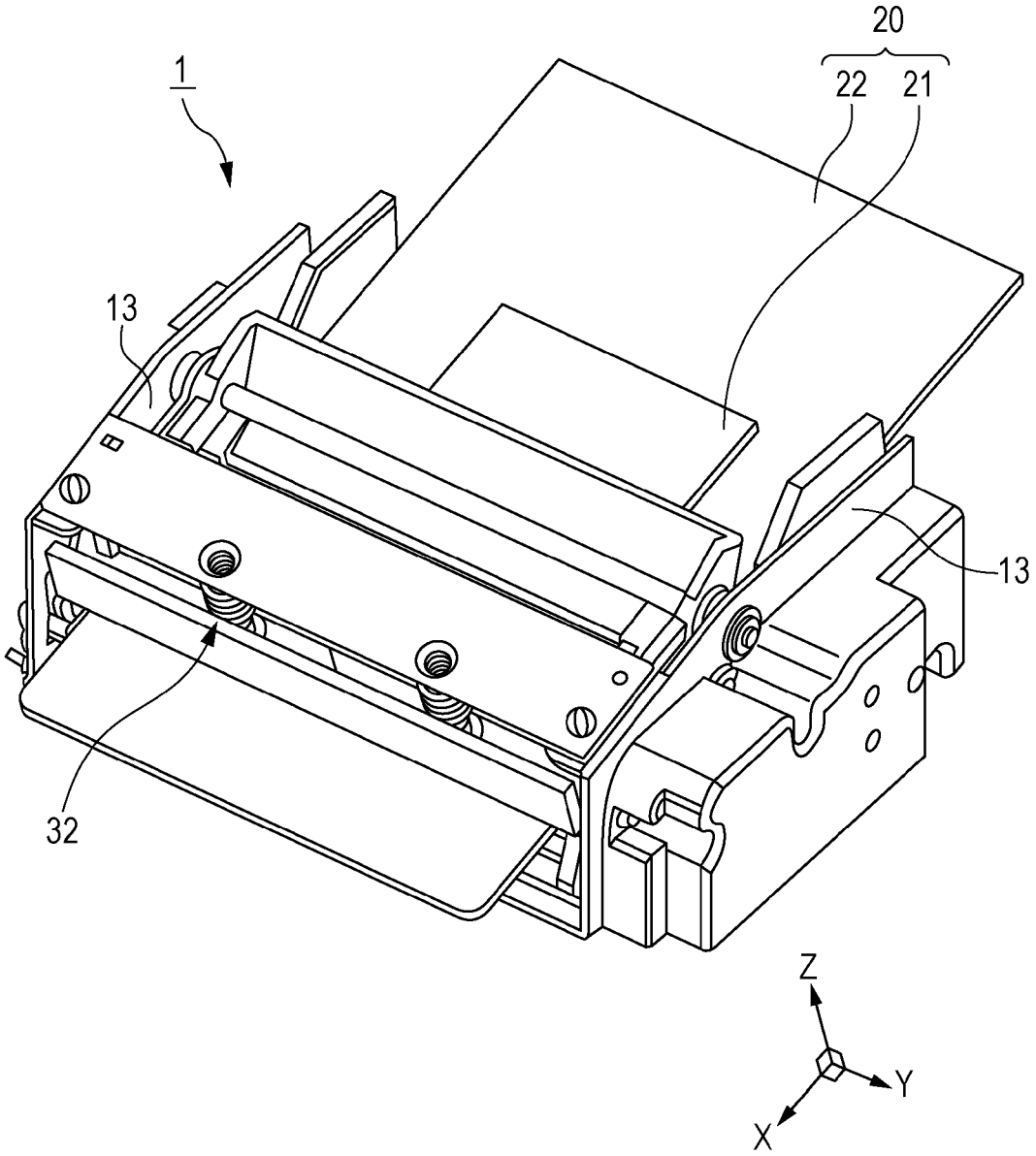
FIG. 3 is a perspective view illustrating the configuration of the main part of a stamp face forming unit applied to the stamp face forming apparatus according to the embodiment.
Figure 4A:
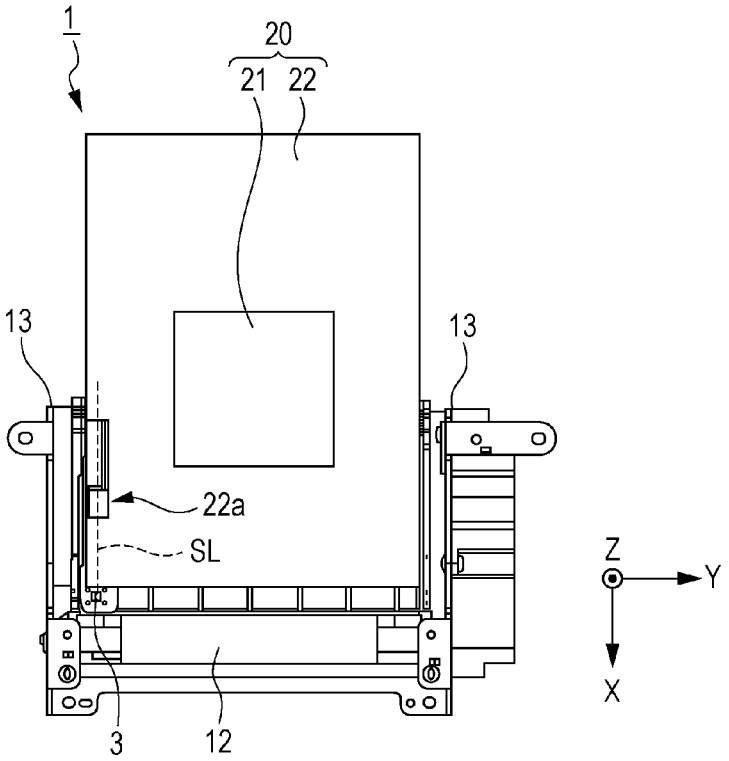
FIG. 4A is a plan view of the configuration of the main part of the stamp face forming unit applied to the stamp face forming apparatus according to the embodiment.
Figure 4B:
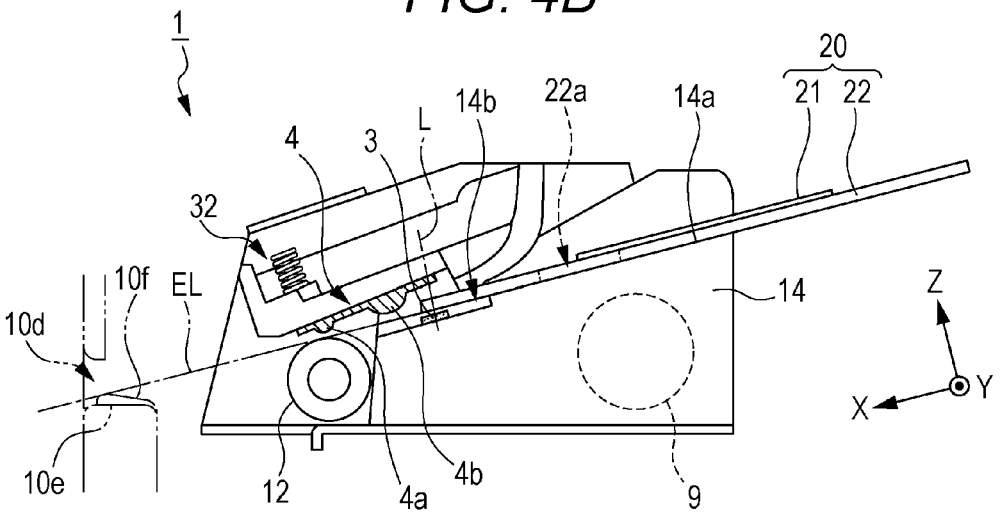
FIG. 4B is a cross-sectional view in which the stamp face forming unit applied to the stamp face forming apparatus according to the embodiment is cut at the vertical plane along the conveying direction.

FIGS. 1A and 1B are schematic perspective views illustrating a stamp face forming apparatus according to one embodiment of the invention, together with a stamp face material holder. FIG. 1A is an external perspective view of the stamp face forming apparatus according to the embodiment. FIG. 1B is a perspective cross-sectional view illustrating a cross-sectional structure in an X-Z plane (a vertical plane including a conveying direction). FIGS. 2A and 2B are schematic diagrams illustrating a structure in the vicinity of an ejection port of the stamp face material holder, which is of the stamp face forming apparatus according to the embodiment. FIG. 2A is a main part cross-sectional view illustrating a cross-sectional structure in a IIA part ("II" is used as a symbol corresponding to a roman numeral "2" illustrated in FIG. 1B and "V" as a symbol corresponding to a roman numeral "5" in the specification for the sake of convenience, and the same shall apply hereinafter) illustrated in FIG. 1B. FIG. 2B is a front view illustrating an appearance of the stamp face forming apparatus including the ejection port. FIG. 3 is a perspective view illustrating the main part of a stamp face forming unit applied to the stamp face forming apparatus according to the embodiment. FIGS. 4A and 4B are a plan view and cross-sectional view of the configuration of the main part of the stamp face forming unit applied to the stamp face forming apparatus according to the embodiment. FIG. 4A is a plan view of the stamp face forming unit. FIG. 4B is a schematic cross-sectional view illustrating a cross-sectional structure in the X-Z plane (the vertical plane including the conveying direction).

A stamp face forming apparatus (hereinafter referred to as the "printer") 1 according to the embodiment is what is called a thermal printer. For example, as illustrated in FIGS. 1A and 1B, the printer 1 conveys, toward an ejection port 10*d*, a stamp face material holder 20 (including a stamp face material 21, a holding body 22 that holds the stamp face material 21, and a film 24 that protects the stamp face material 21 and described in detail below with reference to FIGS. 6A, 6B, and 6C) inserted from an insertion opening 10*c*. The printer 1 then presses a thermal head 4 against the stamp face material 21 on the stamp face material holder 20 during transport via the film 24 with a predetermined load, selectively heats a plurality of heating elements of the thermal head 4, and accordingly forms a stamp face representing a pattern (characters, symbols, figures, and the like) (a part that makes an impression including characters, symbols, and figures when impressing a stamp) on the stamp face material 21 on the stamp face material holder 20.

As illustrated in FIGS. 1A and 1B, X, Y, and Z directions, which are orthogonal to one another, are set. In terms of the symbols X, Y, and Z indicating the directions described in the drawings. "+" is assigned to indicate an arrow direction. "−" is assigned to indicate an opposite direction to the arrow direction. If both directions are indicated, the symbol ("+" or "−") is not assigned. The X direction is the same direction as a direction in which the stamp face material holder 20 including the stamp face material 21 being a target object on which a stamp face is formed is conveyed, and is also called a front-back direction. The Y direction is the same direction as the width direction of the printer 1, and is also called a left-right direction. The Z direction is the same direction as a direction in which the thermal head 4 is pressed against the stamp face material holder 20, and is also called an up-down direction.

As illustrated in FIGS. 1A and 1B, the printer 1 includes a case 10 having a lower case 10*a* and an upper case 10*b*. The insertion opening 10*c* and ejection port 10*d* for allowing the stamp face material holder 20 to pass through are formed on the front and back surfaces of the lower case 10*a*. An input operation unit 6 is provided on the upper surface of the upper case 10*b*. When operated by an operator, the input operation unit 6 outputs a signal responsive to the content of the operation.

For example, as illustrated in FIGS. 2A and 2B, the ejection port 10*d* of the lower case 10*a* has a plurality of ribs (support portions) 10*f* formed in such a manner as to protrude to a predetermined height at the ejection port 10*d* and arranged at predetermined intervals along an opening direction (the Y direction) of the ejection port 10*d* on a lower inner surface 10*e* configuring the ejection port 10*d*. The plurality of ribs 10*f* is arranged in a conveying path of the stamp face material holder 20 that is ejected from the ejection port 10*d*. In other words, the plurality of ribs 10*f* is provided in such a manner as to come into contact with and support a back surface side (a surface opposite to the stamp face formation side against which the thermal head 4 is pressed, that is, the lower side in FIG. 2A) of the stamp face material holder 20 in the vicinity of one end side (+X direction side) of the stamp face material holder 20 when the stamp face material holder 20 inserted from the insertion opening 10*c* is conveyed inside the printer 1, and at least the pressed state of thermal head 4 against the stamp face material holder 20 changes to a specific state. At this point in time, the plurality of ribs 10*f* is provided in such a manner as to come into contact with the back surface of the stamp face material holder 20 to the extent that the stamp face material holder 20 does not bend (deform), more preferably provided in such a manner as to support the stamp face material holder 20 to the extent that there is no influence on the conveyance (feeding amount) of the stamp face material holder 20, for example, to the extent of coming into contact with the stamp face material holder 20 with little friction.

For example, as illustrated in FIGS. 3, 4A, and 4B, the stamp face forming unit incorporated into the case 10 of the printer 1 roughly includes the thermal head (stamp face forming unit) 4, a stepping motor 9, a guide 14, and a platen roller (conveying roller) 12. A pair of plate-shaped side frames 13 facing each other in the Y direction is provided at both ends of the thermal head 4, the guide 14, and the platen roller 12.

As illustrated in FIGS. 4A and 4B, the platen roller 12 is for conveying the stamp face material holder 20 in the X direction, and is provided running between the two side frames 13 and 13. Both ends of the platen roller 12 penetrate the side frames 13. Both end portions of the platen roller 12 are supported by the side frames 13 in such a manner as to be rotatable with respect to the side frames 13. For example, a roller gear (illustration omitted) is integrally attached to an end portion of a rotation shaft of the platen roller 12 on the +Y axis. Driving force accompanied by the rotation of a drive gear (illustration omitted) attached to a drive shaft of the stepping motor 9 is transferred via a plurality of electric gears to rotate the platen roller 12 at a predetermined rotation speed.

An inclined surface 14*a* for guiding the stamp face material holder 20 (the stamp face material 21) to the platen roller 12 is formed on the guide 14. The inclined surface 14*a* is placed such that an extended line EL (depicted by a dot and dash line in the drawing, and corresponding to the conveying path) of the inclined surface 14*a* is tangent to an outer peripheral surface of the platen roller 12 when viewed from the Y direction (in the cross section as viewed from the +Y direction) illustrated in FIG. 4B. As illustrated in FIG. 4B, the protruding height, shape, and arrangement of the ribs 10*f* provided on the inner surface 10*e* of the ejection port 10*d* are set such that their upper surfaces are tangent to the extended line EL of the inclined surface 14*a*.

As illustrated in FIG. 4B, a recess 14*b* of the inclined surface 14*a* is provided with a sensor 3. The sensor 3 is placed slightly closer to the −Z side than the trajectory of the stamp face material holder 20 to avoid contact with the stamp face material holder 20. Moreover, the sensor 3 is placed slightly closer to the +Y side than the left side frame 13 and slightly closer to the −X side than the platen roller 12, when viewed from the Z direction (in the plan view as viewed from the +Z side) illustrated in FIG. 4A, such that a notch 22*a* of the stamp face material holder 20 passes over the sensor 3. A detection scan line SL illustrated as a broken line in FIG. 4A is a line that intersects an optical axis L of the sensor 3 and extends in the X direction. The sensor 3 is a reflective optical sensor, and includes a light emitting element that emits light in the +Z direction, and a light receiving element that receives light hitting a sensor target object (here, the stamp face material holder 20) and reflecting in the −Z direction. The sensor 3 outputs a signal responsive to the amount of light received by the light receiving element. The kind (size) of the stamp face material 21 fit onto the stamp face material holder 20 is identified based on the signal.

The thermal head 4 is provided in such a manner as to face the platen roller 12 as illustrated in FIGS. 2A and 4B. The thermal head 4 presses, via the film 24, the stamp face material 21 on the stamp face material holder 20 that is conveyed in the X direction. A pressing portion 4*a* of the thermal head 4, which presses the stamp face material 21, is provided in a straight belt-shape along the Y direction. The pressing portion 4*a* is provided such that the length of the pressing portion 4*a* (the length in the Y direction) is longer than the width of the stamp face material 21 (the length along the Y direction). Consequently, a straight belt-shaped part extending along the width direction of the stamp face material 21 is evenly pressed by the pressing portion 4*a* and deforms. In the pressing portion 4*a*, a plurality of heating elements (illustration omitted) that are selectively heated upon formation (making) of the stamp face is arranged along the extension direction of the pressing portion 4*a* (the Y direction). Moreover, the thermal head 4 is provided with an IC chip (driver IC) 4*b* including a drive circuit for controlling the heat generation state of each of the plurality of heating elements arranged in the pressing portion 4*a*. The driver IC 4*b* is placed at a position in, for example, an opposite direction (−X direction) to the conveying direction of the stamp face material holder 20 with respect to the pressing portion 4*a* provided with the plurality of heating elements. With such a configuration, areas corresponding to the heating elements heated and generating heat are heated in the straight belt-shaped part of the stamp face material 21 (the part pressed and deformed by the pressing portion 4*a*).

In a general thermal head 4, the pressing portion 4*a* provided with the plurality of heating elements and the driver IC 4*b* for controlling the heat generation state of each of the heating elements are placed close to each other on one side of a printed circuit board (PCB). This is the configuration for reducing the size of the printed circuit board and preventing an increase in cost. Most of general-purpose products adopt this form.

A space between the thermal head 4 and the platen roller 12 (expressed as "H" in FIG. 2A) may be set to a preset fixed value depending on the configuration of the stamp face material holder 20 described below, or a mechanism (expressed as "32" in FIG. 2A) may be included which adjusts the space H between the thermal head 4 and the platen roller 12 by moving the thermal head 4 or the platen roller 12 in the Z direction. Such an adjustment mechanism 32 for the space H between the thermal head 4 and the platen roller 12 is used to enable a change in the pressing force of the thermal head 4 against the stamp face material 21. Especially, if a stamp face is formed (made) on the stamp face material holder 20 holding the stamp face material 21 of a different size (especially a dimension in the width direction), the pressing condition of the pressing portion 4*a* of the thermal head 4 may change depending on the size of the stamp face material 21. Therefore, the adjustment mechanism 32 for the space H between the thermal head 4 and the platen roller 12 is extremely useful to appropriately form a stamp face. In terms of such an adjustment mechanism 32 for the space H, for example, the sensor 3 scans the notch 22*a* of the stamp face material holder 20 to control the adjustment of the space H based on the size of the stamp face material 21 of the stamp face material holder 20, which has been identified by the control unit 2. The smaller the space H is set, the pressing force of the thermal head 4 against the stamp face material 21 increases.

<<Regarding Functional Configuration that Functions by being Controlled by Control Unit (CPU)>>

Next, a description is given of the functional configuration of the printer 1 according to the embodiment, in other words, the functional configuration that functions by being controlled by the control unit (CPU).

Figure 5:
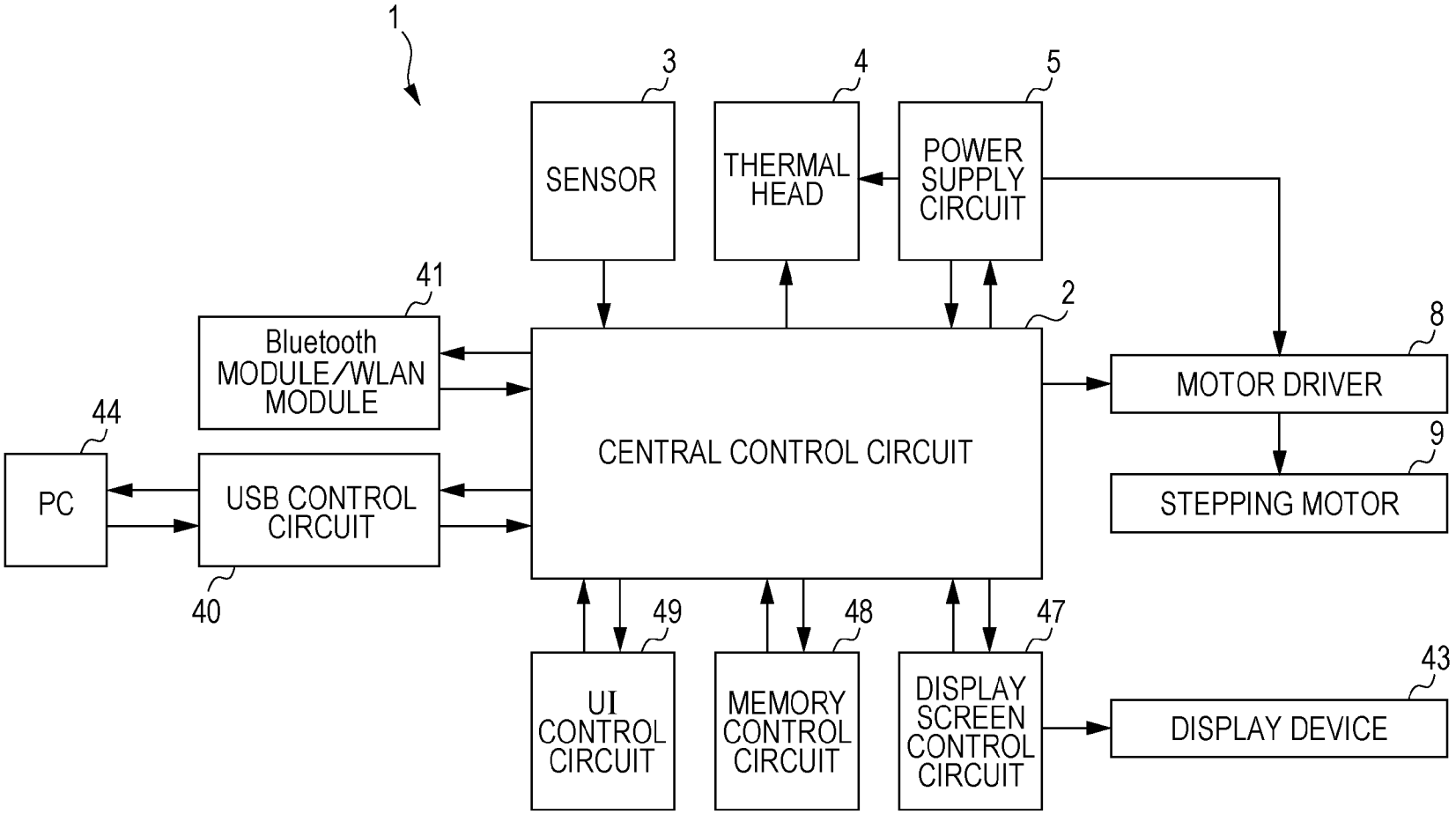
FIG. 5 is a block diagram of the system configuration of the stamp face forming apparatus according to the embodiment.

FIG. 5 is a block diagram of the system configuration of the stamp face forming apparatus (the printer 1) according to the embodiment.

As illustrated in FIG. 5, the printer 1 includes a central control circuit 2. The central control circuit 2 is connected to the sensor 3, the thermal head 4, a power supply circuit 5, a motor driver 8, a display screen control circuit 47, a memory control circuit 48, a UI (user interface) control circuit 49, a USB control circuit 40, and a Bluetooth (registered trademark) module/wireless LAN module 41.

Moreover, the stepping motor 9 is connected to the motor driver 8. A display device 43 is connected to the display screen control circuit 47. A PC (personal computer) 44 is connected to the USB control circuit 40.

The sensor 3 includes a reflective optical sensor in this example, and detects the notch 22*a* provided to the stamp face material holder. The central control circuit 2 detects a signal from the sensor 3 to detect a print start position, a medium size, and the like, and control energization.

Moreover, all of the display device 43, the display screen control circuit 47, the UI control circuit 49, the USB control circuit (USB communication control circuit) 40, the Bluetooth (registered trademark) module/wireless LAN module 41, and the like are not necessarily required.

In FIG. 5, the central control circuit (control unit) 2 controls the entire system. In the drawing, most of the circuits are connected only to the central control circuit 2. However, it is also naturally possible to perform data communication between circuits through a bus. The central control circuit 2 is a circuit including a CPU (central processing unit), and achieves various functions (for example, conveyance amount detection, dimension setting, dimension determination, position detection, heat control, and pressing force control) by the CPU reading and executing a computer program when necessary.

The memory control circuit 48 includes devices such as a ROM (read only memory) and a RAM (Random Access Memory), and controls them. The display device 43 indicates a display device such as an LCD (liquid crystal display). The display screen control circuit 47 controls data transfer and the like to the display device 43, turning-on and -off of a back light, and the like.

Moreover, the computer program necessary to achieve the various functions is stored in the ROM or the like, and written into the RAM when necessary to be referred to or used. Driver software and an application program are installed in a personal computer (or smartphone) side, and the stamp face forming apparatus operates in a coordinated fashion via USB connection or the like. Therefore, the computer program in the stamp face forming apparatus and the computer program installed in an external device such as a personal computer cooperate to achieve the various functions.

For example, in a case of a stamp face forming apparatus (printer) of a type having a configuration that requires a connection or wireless connection to the PC 44, the user performs an operation on a GUI (Graphical User Interface) of the PC 44, an unillustrated mobile phone terminal, or the like. Accordingly, the display screen control circuit 47 and the display device 43 are not necessarily required on the hardware side.

The UI (user interface) control circuit 49 performs control of menu screen display and the like based on information input by the user from an input device such as a keyboard, mouse, remote controller, button, touchscreen, or the like via the personal computer, or via an input device provided to the stamp face forming apparatus (printer). The power supply circuit 5 includes a power IC (integrated circuit), and generates power necessary to each circuit and supplies the power.

The thermal head 4 receives data and a print signal, which are output from the central control circuit 2, controls current-carrying dots by the driver IC in the head, and performs printing (including formation of a stamp face and typing and hereinafter collectively referred to as printing) on the stamp face material such as a porous ethylene vinyl acetate copolymer (hereinafter EVA) in contact with the head. "Printing" of the stamp face forming apparatus is not printing with ink but indicates performing a process of whether or not to make the surface of the stamp face material 21 non-porous on a dot (unit of the heating element) basis by selectively heating the heating elements of the thermal head 4 according to image data.

In the configuration example of the system, other circuits receive only data and a signal from the central control circuit 2, and obtain power necessary for printing from the power supply circuit 5. For information, in the apparatus of this example, the thermal head 4 has 200 dpi, that is, a resolution of 200 dots/25.4 mm (a resolution of 0.125 mm per dot) and an effective print width of 48 mm.

The motor driver 8 is a drive circuit that drives the stepping motor 9, receives a signal output from the central control circuit 2, and supplies a pulse signal and power for driving to the stepping motor 9. The motor driver 8 receives only an excitation signal from the central control circuit 2, and obtains the actual drive power from the power supply circuit 5.

The control unit (central control circuit) 2 counts the number of pulses of the signal output to the motor driver 8 and accordingly can accurately grasp how many times the stepping motor 9 has been rotated, in other words, how many mm the stamp face material holder has been conveyed by the platen roller 12.

The printer 1 in the embodiment adopts 1-2 phase excitation drive and is configured in such a manner as to have a gear ratio of 16 steps per line (0.125 mm) In other words, conveyance of 0.0078 mm is performed in one step.

A distance conveyed by the platen roller 12 may be calculated in the control unit 2 not based on the number of pulses but using another method. For example, the number of rotations of the platen roller 12 may be detected by a rotary encoder to calculate a distance conveyed by the platen roller 12 based on the detected number of rotations.

<<Regarding Configuration of Stamp Face Material Holder>>

Next, the stamp face material holder 20 that forms (makes) a stamp face by the printer 1 is described with reference to FIGS. 6A, 6B, 6C, 7A, and 7B.

Figure 6A:
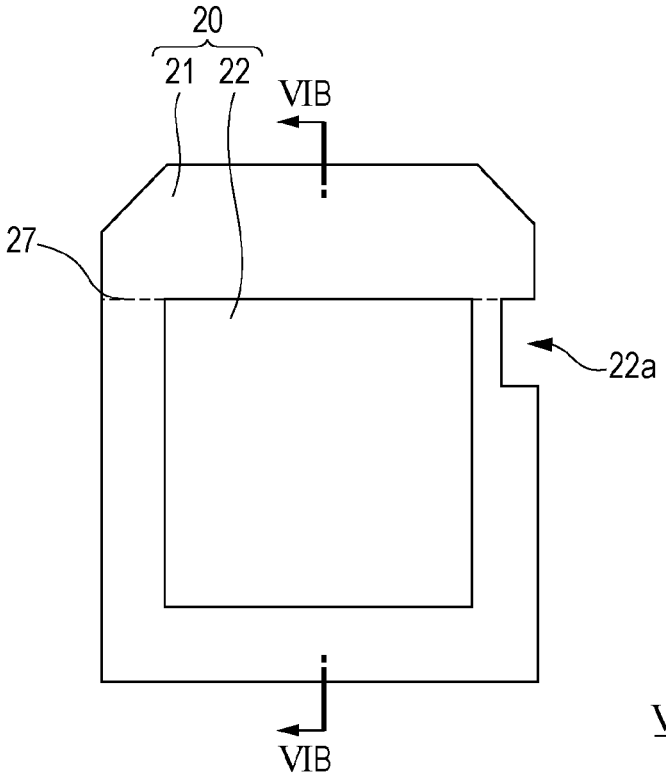
FIG. 6A is a plan view illustrating an example of the stamp face material holder that holds a stamp face material on which a stamp face is formed by the stamp face forming apparatus according to the embodiment.
Figure 6B:
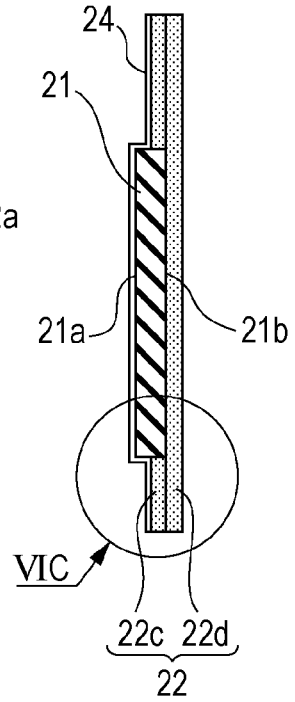
FIG. 6B is a VIB-VIB cross-sectional view of FIG. 6A, in other words, a cross-sectional view cut along the vertical plane including the conveying direction.
Figure 6C:
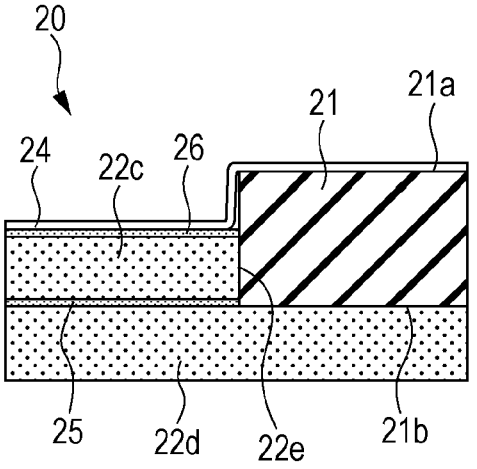
FIG. 6C is a cross-sectional view illustrating the details of a VIC part encircled in FIG. 6B.
Figure 7A:
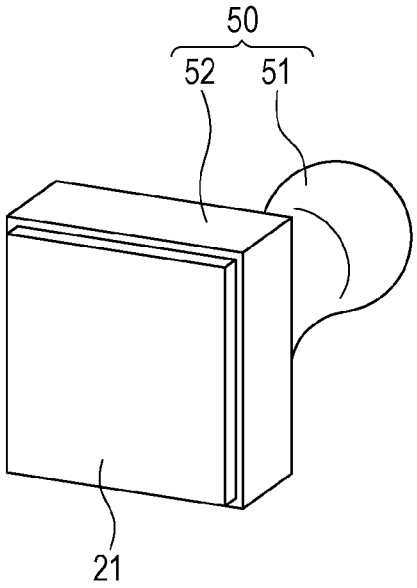
FIG. 7A is an external perspective view illustrating a state where the formation of the stamp face is complete, and the stamp face removed from the stamp face material holder is attached to a block of a stamp to be completed as a stamp.
Figure 7B:
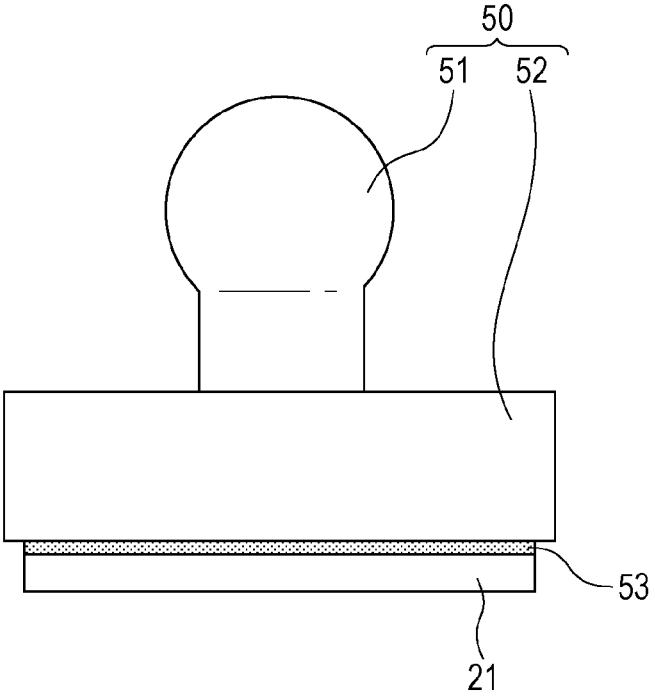
FIG. 7B is a side view of FIG. 7A.

FIGS. 6A, 6B, and 6C are schematic diagrams illustrating an example of the stamp face material holder where the stamp face is formed by the printer according to the embodiment. FIG. 6A is a plan view illustrating the stamp face formation side (the side holding the stamp face material 21) of the stamp face material holder 20. FIG. 6B is a schematic cross-sectional view illustrating a cross-sectional structure along line VIB-VIB ("VI" is used as a symbol corresponding to a roman numeral "6" illustrated in FIG. 6A in the specification for the sake of convenience) illustrated in FIG. 6A. FIG. 6C is a cross-sectional view of the main part illustrating a cross-sectional structure of a VIC part illustrated in FIG. 6B. FIGS. 7A and 7B are schematic diagrams illustrating an example of a stamp to which the stamp face material on which the stamp face has been formed is attached. FIG. 7A is a perspective view of the stamp when viewed from the stamp face material side. FIG. 7B is a side view of the stamp when the stamp face material side is set as the bottom surface (when placed on paper or the like to be use as the stamp).

The stamp face material holder 20 includes the stamp face material 21, the holding body 22 that holds the stamp face material 21, and the film 24 that protects the stamp face material 21. As illustrated in FIGS. 6A and 6B, the holding body 22 fixes and holds the stamp face material 21 in the center.

The stamp face material 21 includes a main surface 21*a* that actually serves as the stamp face. The stamp face material 21 includes a porous sponge body that can impregnate liquid ink, for example, a porous ethylene vinyl acetate copolymer (hereinafter written as "EVA"), and can deform by a press. EVA includes countless voids. The ink is impregnated into the voids.

The holding body 22 and the film 24 of the stamp face material holder 20 are tools used upon the formation of the stamp face on the stamp face material 21 and, after the end of the formation of the stamp face, are separated from the stamp face material 21 and disposed of (or reused). As illustrated in FIGS. 6B and 6C, an upper paperboard 22*c* and a lower paperboard 22*d*, which are made of coated board, are pasted onto each other to form the holding body 22. Moreover, as illustrated in FIG. 6A, the notch 22*a* is formed in one side portion (in the right in the drawing) of the holding body 22. The surface of the holding body 22 is formed in, for example, white to reflect light from the sensor 3 at a high reflectance.

As illustrated in FIGS. 6B and 6C, a positioning hole 22*e* for fixing the stamp face material 21 is formed in the center of the upper paperboard 22*c*. The stamp face material 21 is fit into the positioning hole 22*e* and fixed therein. As illustrated in FIGS. 6A and 6B, the lower paperboard 22*d* is formed into the same shape as the outer shape of the upper paperboard 22*c*, and is not provided with the positioning hole 22*e*. The lower paperboard 22*d* is in contact with an entire back surface 21*b* of the stamp face material 21 in a state of being pasted onto the upper paperboard 22*c*.

As illustrated in FIGS. 6B and 6C, the main surface 21*a* (the left surface in FIG. 6B or the upper surface in FIG. 6C) of the stamp face material 21 is configured in such a manner as to slightly protrude from the upper surface (the left surface in FIG. 6B, or the upper surface in FIG. 6C) of the upper paperboard 22*c*. In the embodiment, the total thickness of the upper paperboard 22*c* and the lower paperboard 22*d* is set to, for example, 1.2 mm. On the other hand, the overall thickness of the stamp face material holder 20 including the film 24 and the stamp face material 21 is set to, for example, 1.8 mm. In other words, in the example, the stamp face material 21 is set in such a manner as to protrude from the upper paperboard 22*c* by 0.6 mm.

Moreover, as illustrated in FIGS. 6B and 6C, the stamp face material holder 20 includes the film 24 that covers the upper surface of the holding body 22 and the upper surface of the stamp face material 21. The film 24 is made based on PET (Polyethylene Terephthalate), polyimide, or the like, and has heat resisting property, thermal conductivity, and surface smoothing capability. In terms of the heat resisting property of the film 24, a film is used which can withstand a higher temperature than the temperature of the thermal head 4 upon formation of the stamp face, and the melting point of the stamp face material 21. Moreover, in terms of thermal conductivity of the film 24, a film is used which can transfer, to the stamp face material 21, the heat of the thermal head 4 upon formation of the stamp face, and excellently melt the stamp face material 21. In terms of the surface smoothing capability of the film 24, a film is used along which the pressing portion 4*a* of the thermal head 4 that comes into contact upon formation of the stamp face reasonably slides with little friction.

As illustrated in FIG. 6C, the upper paperboard 22*c* and the lower paperboard 22*d* are pasted onto each other by, for example, a double-sided adhesive sheet 25. Moreover, the film 24 is adhered by a double-sided adhesive sheet 26 to the surface of a peripheral portion of the holding body 22, in other words, the surface of the upper paperboard 22*c* onto which the stamp face material 21 is fit. Between the film 24 and the stamp face material 21 and between the stamp face material 21 and the lower paperboard 22*d* are simply in contact, but not pasted.

FIGS. 6A, 6B, and 6C illustrate an example of the stamp face material holder 20 being a target to form the stamp face in the printer 1 according to the embodiment. However, a plurality of kinds of stamp face material holder 20 holding the stamp face materials 21 of different sizes (dimensions in the longitudinal and lateral directions in FIG. 6A) can be targeted to form stamp faces. The thickness and width dimension (the dimension in the lateral direction in FIG. 6A) of each kind of stamp face material holder 20 are set to the same values, respectively. The length dimension (the dimension in the longitudinal direction in FIG. 6A) of the stamp face material holder 20 is set to be different depending on the size of the stamp face material 21. Moreover, the notch 22*a* of a different size (for example, the dimension in the longitudinal direction) is provided to the holding body 22 in a one-to-one relationship, depending on the size of the stamp face material 21 of each kind of stamp face material holder 20. The notch 22*a* of the holding body 22 is then scanned by the sensor 3 of the printer 1 to detect its size. Accordingly, the kind (size) of stamp face material 21 of the stamp face material holder 20 is identified.

The stamp face material 21 is removed from the holding body 22 after the formation of the stamp face ends in the printer 1. For example, as illustrated in FIGS. 7A and 7B, the removed stamp face material 21 is then pasted by a double-sided adhesive sheet 53 or the like on the undersurface of a block 52 (the surface on the lower side of the block 52 in FIG. 7B) of a stamp 50 including a spherical handle 51 and the square block 52.

<<Regarding Principle of Formation of Stamp Face>>

Next, the principle of formation of a stamp face on the stamp face material 21 is described.

The stamp face material 21 includes EVA. EVA has thermoplastic properties. Accordingly, if EVA is heated at, for example, 70° C. to 120° C., areas to which heat has been applied are softened, and the areas that have softened once are cured when cooled down. The void portions in the cured areas are filled to become non-porous. The areas do not allow the ink to pass through.

The printer 1 according to the embodiment makes use of the properties of the stamp face material 21 (EVA) and heats given areas on the surface of the EVA with the thermal head for approximately one msec to five msec. Accordingly, the given areas on the surface of the EVA are made non-porous to prohibit the passage of the ink through the areas. The stamp face material 21 is cut in advance into a square by a thermal cutting machine. Hence, all four side faces (end faces) of the stamp face material 21 have been made non-porous by the heat applied upon cutting and accordingly do not allow the ink to pass through. A heat treatment is performed also on the back surface 21*b* of the stamp face material 21 so that the back surface 21*b* does not allow the ink to pass through. Consequently, the ink is prevented from exuding from surfaces other than the main surface 21*a* that serves as the stamp face.

In the formation (thermal printing) of the stamp face, parts that allow the ink to pass through are not heated, and parts that do not allow the ink to pass through are heated. Consequently, ink passing parts can be formed in accordance with an impression that is desired to obtain when the stamp is impressed. Considering possible errors during formation of the stamp face and the fact that the ink does not pass through the side faces (end faces) of the stamp face material 21, the size of the stamp face material 21 is set to be slightly larger than the impression size. For example, if the size of the impression is 45 mm×45 mm, the size of the stamp face material 21 is set to 48 mm×48 mm.

<<Regarding Stamp Face Forming Operation>>

Next, a description is given of the stamp face forming operation of forming the stamp face in the printer 1 according to the embodiment. The functions illustrated below are stored in the control unit 2 (more specifically, the ROM) in the form of a readable program code, and operations are sequentially executed in accordance with the program code. As illustrated in the system block diagram in FIG. 5, the stamp face forming apparatus (the printer 1) normally operates in coordination with a personal computer, a smartphone, or the like. A description is given here, limiting to operations in the printer 1 to avoid a complicated description.

Figure 8A:
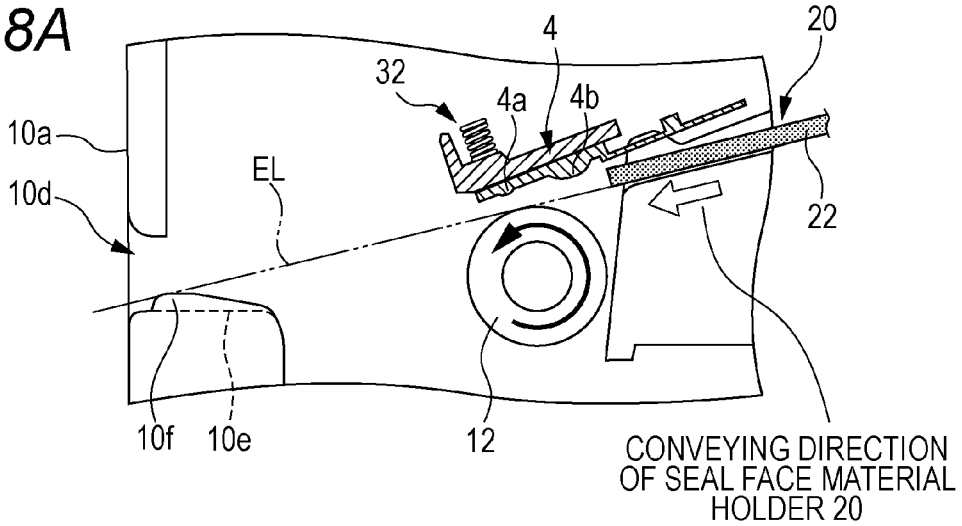
FIGS. 8A, 8B, and 8C are schematic cross-sectional views illustrating the states of forming the stamp face by a printer according to the embodiment.
Figure 8B:
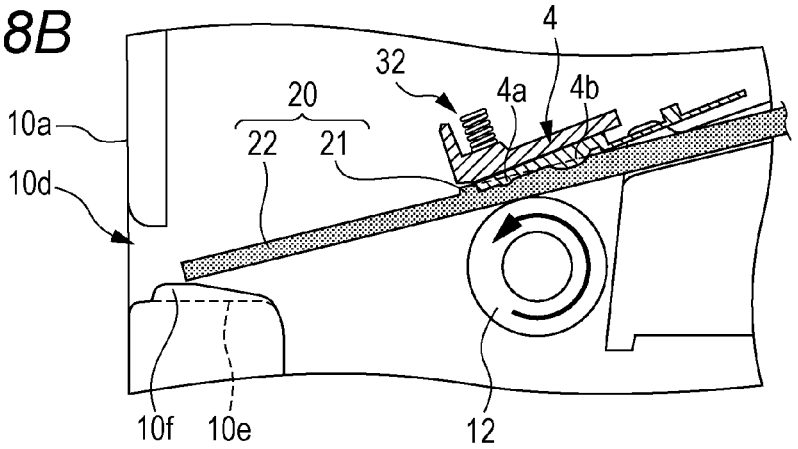
Figure 8C:
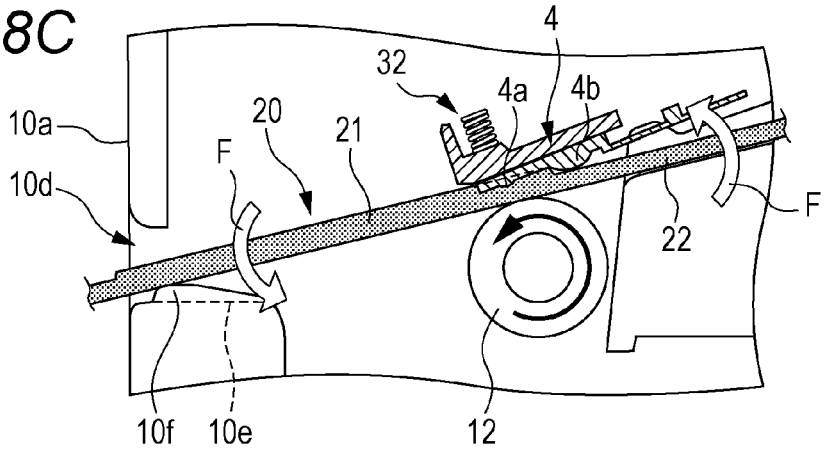

FIGS. 8A, 8B, and 8C are schematic cross-sectional views illustrating the states of forming the stamp face by the printer according to the embodiment.

In the stamp face forming operation of the printer 1, firstly, the control unit 2 executes an initial operation of the printer 1 when the input operation unit 6 is pressed and a signal to start the printer 1 is input from the input operation unit 6. In the initial operation of the printer 1, the control unit 2 transmits a drive signal to the motor driver 8, and rotates the stepping motor 9 for a predetermined time period. Consequently, the platen roller 12 rotates for the predetermined time period. Even if the stamp face material holder 20 remains in the printer 1, the stamp face material holder 20 is ejected from the ejection port 10*d* to the outside of the printer 1.

After the end of the initial operation, as illustrated in FIG. 8A, when a start signal to start forming the stamp face (for example, a signal output from the input operation unit 6 after the initial operation and indicating that a press operation has been performed on the input operation unit 6) is input from the input operation unit 6 in a state where the stamp face material holder 20 has been inserted by the operator of the printer 1 from the insertion opening 10*c* into the printer 1, the control unit 2 rotates the stepping motor 9 to rotate the platen roller 12. Consequently, the stamp face material holder 20 is conveyed in the +X direction along the guide 14 (the inclined surface 14*a*).

If targets for the formation of the stamp face include the stamp face material holders 20 of a plurality of kinds (sizes), the control unit 2 detects the length of the notch 22*a* of the stamp face material holder 20 (the holding body 22) by the sensor 3, and identifies the kind of stamp face material holder 20 (the size of the stamp face material 21). The control unit 2 then controls the adjustment mechanism 32 for the space H between the thermal head 4 and the platen roller 12 based on the identified kind of stamp face material holder 20 and sets the space H in accordance with the kind of stamp face material holder 20. Consequently, the pressing force of the thermal head 4 against the stamp face material 21 is appropriately set in accordance with the kind of stamp face material holder 20. Moreover, the width of the stamp face material 21 is also detected. Accordingly, the heating time (the time during which the thermal head is energized) in accordance with the width is also controlled (this is described below with reference to FIGS. 9A, 9B, and 10).

As illustrated in FIG. 8B, when the stamp face material holder 20 is conveyed further in the +X direction, the pressing portion 4*a* of the thermal head 4 reaches the stamp face material 21 passing over the upper surface of the holding body 22. The stamp face material 21 of the stamp face material holder 20 is drawn to under the thermal head 4, and conveyed while pressed at a predetermined pressing force. The stamp face is formed by receiving the heat from the heating elements arranged in the Y direction in the pressing portion 4*a* of the thermal head 4.

Specifically, the control unit 2 performs control while coordinating the conveyance of the stamp face material holder 20 (the rotation of the stepping motor 9) and the selection of heating elements of the thermal head 4 to be caused to generate heat, selectively heats positions in accordance with the image data of the stamp face material 21, forms ink passing and non-passing parts in accordance with the image data, and accordingly forms a stamp face.

At this point in time, EVA applied to the stamp face material 21 is a porous sponge body and is very soft. Accordingly, it is necessary to press the heating elements of the thermal head 4 against the stamp face material 21 of the stamp face material holder 20 with more pressure than a printer that performs normal thermal printing in order to form (thermally print) the stamp face appropriately. Hence, as illustrated in FIGS. 6B and 6C, the main surface 21*a* of the stamp face material 21 is configured to protrude from the upper surface of the holding body 22. Moreover, as illustrated in FIG. 8B, the pressing state of the thermal head 4 against the stamp face material 21 of the stamp face material holder 20 is in a state where, in addition to the pressing portion 4*a* in which the heating elements of the thermal head 4 are arranged, the driver IC 4*b* placed in the vicinity of the heating elements is also pressed against the stamp face material 21 and is dug into the stamp face material 21.

When the stamp face material holder 20 is conveyed further in the +X direction while forming the stamp face on the stamp face material 21, the thermal head 4 reaches an end (trailing edge) of the stamp face material 21 in the −X direction, and passes a boundary portion between the stamp face material 21 and the holding body 22 as illustrated in FIG. 8C. At this point in time, an end side of the holding body 22 of the stamp face material holder 20 in the conveying direction (+X direction) reaches at least the ejection port 10*d*. The plurality of ribs 10*f* provided on the inner surface 10*e* of the ejection port 10*d* comes into contact with the back side (the surface opposite to the stamp face formation side against which the thermal head 4 is pressed, the lower surface side in the drawing) in the vicinity of the end side to support the stamp face material holder 20.

The stamp face material 21 is configured in such a manner as to protrude toward the thickness direction with respect to the holding body 22. Accordingly, there is a level difference in the boundary portion between the stamp face material 21 and the holding body 22. Moreover, the driver IC 4*b* is placed in the vicinity (−X direction) of the pressing portion 4*a* of the thermal head 4. In addition, the thermal head 4 is strongly pressed against the stamp face material 21. Accordingly, the thermal head 4 passes over the boundary portion to cause the driver IC 4*b* of the thermal head 4 to move down the level difference first. At this point in time, the pressing force of the drive IC 4*b* of the thermal head 4 against the stamp face material holder 20 (the stamp face material 21) momentarily becomes released, and a force to rotate the stamp face material holder 20 (the end in the +X direction is biased downward and the end in the −X direction is biased upward) is added as illustrated by arrows F in FIG. 8C.

In a configuration where the ribs 10*f* are not placed at the ejection port 10*d* of the printer 1, the end side of the stamp face material holder 20 in the +X direction is not supported. Accordingly, at the instant when the driver IC 4*b* of the thermal head 4 moves down the level difference between the stamp face material 21 and the holding body 22, the forces F occurring on the stamp face material holder 20 rotate the stamp face material holder 20, which results in a change in the feeding amount (feeding density) of the stamp face material holder 20 by the platen roller 12. Hence, unevenness (for example, projections and depressions extending in a line form in the Y direction) may appear in the print on the main surface 21*a* of the stamp face material 21 on which the stamp face is formed, due to the change in the feeding amount, and the stamp face may not be formed appropriately.

Contrarily, in the embodiment, as illustrated in FIGS. 2A, 2B, 4A, and 4B, the plurality of ribs (protruding members) 10*f* formed such that their upper surfaces are tangent to the extended line EL of the inclined surface 14*a*, which is the conveying path of the stamp face material holder 20 to be conveyed during the operation of forming the stamp face, is placed on the lower inner surface 10*e* of the ejection port 10*d*. Consequently, the stamp face material holder 20 is supported in the conveying path by the inclined surface 14*a*, the platen roller 12, and the plurality of the ribs 10*f* provided to the ejection port 10*d*. Therefore, the phenomenon that the forces F occurring on the stamp face material holder 20 rotate the stamp face material holder 20 at the instant when the driver IC 4*b* of the thermal head 4 moves down the level difference between the stamp face material 21 and the holding body 22 is prevented. Accordingly, the stamp face is formed appropriately.

The stamp face material holder 20 is conveyed further in the +X direction, and the formation of the stamp face on the stamp face material holder 20 is completed. The stamp face material holder 20 is then ejected from the ejection port 10*d* of the printer 1. The control unit 2 subsequently stops the platen roller 12 by stopping the stepping motor 9, and ends a series of the stamp face forming operations. The timing to stop the stepping motor 9 is set in the control unit 2 to, for example, a timing after a lapse of a predetermined time since the rear end of the stamp face material holder 20 has passed the sensor 3.

<<Regarding Roles of Holding Body 22 and Film 24>>

EVA is a member having a thickness of 1.5 mm, and has high elasticity and coefficient of friction. Hence, even if the EVA is inserted into the thermal printer and conveyed as it is, the friction force between the thermal head and the EVA is large. Accordingly, stable and straight conveyance cannot be performed. In other words, the EVA has large friction force and is soft like rubber. Accordingly, even if a guide is attached to the thermal printer to obtain straight line stability, when a bend occurs no matter how small during conveyance, the EVA itself bends, which results in the immediate occurrence of a skew.

The above difficulty in conveying the EVA is the phenomenon that occurs also in a non-heated state where the thermal head does not generate heat. However, if the thermal head generates heat, the temperature of the thermal head increases up to approximately 200° C. in several milliseconds after the start of the heat generation. Accordingly, a phenomenon occurs in which the surface of the EVA is softened at the instant when the surface is heated, and the thermal head is buried in the softened part so that it becomes totally impossible to convey the EVA.

In cases of a system using an edge head and a system in which a carriage is incorporated to move and drive the head, the above problem does not arise. However, these systems have a disadvantage that invites upsizing of the mechanism and a dramatic increase in costs of members used.

In the invention, in order to form a stamp face with the printer 1 having a normal thermal head, using, as a stamp plate, the EVA having the above difficulty in transport performance without inviting upsizing of the mechanism and a dramatic increase in cost, the stamp face material holder 20 and the holding body 22 are used and the EVA is protected by the film 24.

Moreover, the stamp face material 21 is positioned and fixed by the positioning hole 24 of the upper paperboard 22*c*, and is held from its lower surface by the lower paperboard 22*d*, and its upper surface is covered by the film 24. Accordingly, the stamp face material 21 maintains the shape in a state of being held by the stamp face material holder 20 and does not deform even if the external force in the X and Y directions is applied thereto.

Therefore, as the stamp face material holder 20 is conveyed, the stamp face material 21 is also conveyed accordingly. If the stamp face material holder 20 is linearly conveyed, the stamp face material 21 is also linearly conveyed accordingly. Moreover, the film 24 has a heat resistance property against a higher temperature than the melting point of the stamp face material 21, that is, EVA.

Therefore, even if the surface of the stamp face material 21 melts due to the heat generated by the thermal head 4, the film 24 does not melt. In other words, the coatability as the film is not lost. Moreover, the film 24 has an extremely small friction force against the thermal head 4.

Hence, the thermal head 4 is not buried in the melted and softened stamp face material 21 due to the coatability of the film 24, and thermal printing (stamp face formation) can easily be continued along the surface of the film 24 due to the low friction property against the film 24. In this manner, the formation of the stamp face on the stamp face material 21 is complete.

<<Usage after Removing Stamp Face Material after Formation of Stamp Face>>

In this manner, print data is used to heat the surface of the EVA with the thermal head. Accordingly, it is possible to form the stamp face having a user original impression and to make it easy for the film 24 to come off along the shape of the stamp face material. The removal of the finished stamp plate from the stamp face material holder 20, the stamp plate on which the stamp face has been formed on the stamp face material, simply requires bending the holding body 22 along perforations 27 (see FIG. 6A) and pulling the stamp face material 21 out. The stamp face material after the formation of the stamp face is subsequently pasted on the block 52. The stamp face is impregnated with ink for a fixed time period, or ink is applied to the stamp face depending on the viscosity of the ink and the stamp face is left for a predetermined time period. Consequently, the ink is impregnated into the stamp plate. After removing extra ink smears on the stamp face, or impressing the stamp for a try several times, the user holds the handle 51 with the fingers, and presses the stamp against an impressing target object. The impregnated ink is then pushed out of the stamp face to make an impression.

<<Regarding Contact Between Thermal Head and Stamp Face Material>>

A heating target of the thermal head with the application of the invention is the stamp face material holder 20 (the stamp face material 21 held by the holding body 22).

In other words, it is a structure in which, in order to convey a thermally set EVA without problems and prevent EVA having low elasticity from being skewed (or bent) during printing by interposing a PET film between porous EVA being the stamp face material and the thermal head, the EVA is set onto the holding body 22 whose base material is coated board to stamp the EVA, as if pressed, by a PET film (see FIGS. 6B and 6C).

However, the EVA as the stamp face material has a thickness of 1.0 mm or more. Accordingly, it is normally necessary to construct a printer using an edge head.

This is because suppose the stamp face material is hard, the end face of the thermal head hits the stamp face material and the heating elements of the thermal head cannot contact the stamp face material as illustrated in FIG. 9A.

Normally, if such a thick medium is printed, what is called an edge head having heating elements in a side face portion of a thermal head is used (for example, printing on a thick card).

However, the edge head is high in manufacturing costs. If the edge head is mounted, the price of the product is largely increased.

Hence, in the printer, the fact that porous EVA has physical properties of low elasticity (like rubber) is focused, and the EVA is pressed with high pressure. Accordingly, the end face of the thermal head is pressed into the EVA. As a result, the heating elements are brought into contact with the EVA. Thus, printing with a normal thermal head advantageous in terms of costs is enabled (FIG. 9B).

<<Relationship Between Breadth of Stamp Face Material and Pressure on Stamp Face Material>>

In printing on the stamp face material holder 20 used by the stamp face forming apparatus according to the invention, a pressure per unit length applied by the thermal head (hereinafter simply, pressure) changes depending on the width of the EVA included in the stamp face material 21. The width of the stamp face material 21 (EVA) is a width in the main scan direction of the thermal head (the direction in which the heating elements of the thermal head are arranged), and is a width in a direction orthogonal to the direction in which the stamp face material holder 20 is inserted into the stamp face forming apparatus (the conveying direction).

As illustrated in FIGS. 2A, 4B, 8A, 8B, 8C, and the like, the stamp face forming apparatus according to the invention is provided with the adjustment mechanism 32 for the space H between the thermal head 4 and the platen roller 12. Accordingly, the thermal head 4 is configured to press the stamp face material 21. The adjustment mechanism 32 for the space H is realized by, for example, a coil spring. The coil spring is considered to have a uniform pressing force on the entire stamp face material 21. As a consequence, a pressure per unit length applied to the stamp face material 21 changes depending on the difference in the width of the stamp face material.

In other words, if the width of the stamp face material is small, the pressing force per unit length is increased compared with a wide stamp face material. Hence, if control is performed with a uniform heating amount (current-carrying time), a problem arises in which dots are slightly crushed in a case of a narrow EVA (a state where more parts than the impression become non-porous and the passage of the ink is prohibited), and the print is slightly faint in a case of a wide EVA (a state where a part that does not become non-porous is created compared with the impression, and the passage of the ink cannot be prohibited).

<<Difference in Crushed Amount of Stamp Face Material>>

In the stamp face forming apparatus according to the invention, the adjustment mechanism 32 for the space H between the thermal head 4 and the platen roller 12 applies pressing force to crush the stamp face material (EVA). Accordingly, the heating elements and the EVA are brought into contact with each other. However, there arises a problem that a pressure (linear load) on the EVA changes depending on the breadth of the EVA.

For example, the stamp face forming apparatus (thermal printer) according to the embodiment is designed to apply a pressure of approximately 408 g/cm to a 45-mm wide EVA. A pressure is 612 g/cm for a 30-mm wide EVA, and reaches 1225 g/cm for a 15-mm wide EVA.

When the pressure changes, how the heating elements contact the EVA and how the heat is transferred to the EVA change. Accordingly, for example, if an EVA having a different width is heated keeping a heating amount set for the 30-mm wide EVA, dots are slightly crushed in a case of a narrow EVA to which a high pressure is applied. Contrarily, the print is slightly faint in a case of a wide EVA to which a low pressure is applied. This is because if the pressure is high, the heating elements are completely buried in the EVA, but if the pressure is low, the heating elements are slightly buried to the extent of touching the surface.

In terms of the crushed amount of the stamp face material at this point in time, when the pressure is applied to the stamp face material 21 (EVA) in the embodiment, the crushed amount of the EVA is approximately 0.5 mm for the width of 15 mm (the head hits the part of the holding body (coated board) 22 so that the crush stops at the crushed amount of 0.5 mm, but if not held by the holding body (coated board) 22, it may be crushed further), approximately 0.45 mm for the width of 30 mm, and approximately 0.3 mm for the width of 45 mm.

<<Current-Carrying Table>>

In the stamp face forming apparatus according to the invention, the sensor 3 reads and acquires a difference in the width of the stamp face material 21 (EVA) held by the stamp face material holder 20 used upon printing. In other words, the sensor 3 reads the notch 22*a* provided to the stamp face material holder 20. Accordingly, the control unit 2 acquires information on the width of the stamp face material 21. The heating amount (the length of the current-carrying time) is changed depending on the information on the width to handle the above problems.

A specific description is given of the change of the heating amount. Firstly, a current-carrying table that can print without faint print for the width of 45 mm is created. The current-carrying table is a table for setting a current-carrying time depending mainly on the difference in environmental temperature. The thermal head 4 is provided with a temperature sensor (thermistor), measures the temperature that rises with the heat generation of the thermal head 4 in real time to transmit the temperature to the control unit 2 at each measurement. The temperature in the vicinity of the thermal head 4 (the environmental temperature) can change largely depending on the operating condition of the thermal head. For example, if solid printing is performed continuously, the environmental temperature increases significantly compared with the room temperature. Hence, a thermistor is generally provided in the vicinity of the thermal head to use the thermal head and the environmental temperature is measured and transmitted to the control unit (CPU) at each measurement. The control unit includes the current-carrying table (the reference table for changing the length of the current-carrying time depending on the difference of the environmental temperature), and refers to the current-carrying table to transmit a control signal to the drive circuit of the thermal head. The drive circuit applies a current-carrying signal to the thermal head based on the control signal. The heating elements then generate heat.

Moreover, the heating amount can also be controlled by changing a current-carrying voltage of the thermal head without changing the length of the current-carrying time of the thermal head.

Moreover, that the length of the current-carrying time of the thermal head and that the current-carrying voltage of the thermal head is changed can also be combined to control the heating amount.

<<Setting of Offset Value for Current-Carrying Time>>

In the stamp face forming apparatus according to the invention, in the case of the width of 30 mm, the heating time (current-carrying time) is reduced in each dot (the unit of the heating element) by approximately 500 μsec from the length of the current-carrying time based on the current-carrying table. In other words, an offset value of 500 μsec is provided.

Similarly, in the case of the width of 15 mm, the heating time is reduced in each dot by approximately 1000 μsec from the current-carrying table. In other words, an offset value of 1000 μsec is provided.

A theoretical value of the offset value is difficult to obtain by calculation. Accordingly, it has been decided by an experiment. Moreover, the offset value can also vary depending on the temperature condition.

Moreover, the offset value may not be a subtraction of the fixed value but may be obtained by multiplying the length of the current-carrying time by a fixed ratio. For example, let the width of 45 mm be 100%, let the width of 30 mm be 90%, and let the width of 15 mm be 85%.

A matrix compiling the above is illustrated in FIG. 10. FIG. 10 is a diagram illustrating the relationship between the width of the stamp face material, a pressure, a crushed amount, and an offset value. The top fields in FIG. 10 indicate the sizes of the width of the stamp face, 15 mm, 30 mm, and 45 mm sequentially from the left. As illustrated in FIG. 10, the smaller the width, the larger the pressure per unit length. Accordingly, the smaller the width of the stamp face material, the larger the crushed amount of the stamp face material. The offset value is a value to shorten the current-carrying time for a narrow stamp face material to prevent a crush and faint print in the formation of the stamp face due to the difference of the width of the stamp face material.

The values listed here are reference values of the stamp face forming apparatus according to the embodiment. In an apparatus having different design conditions, the values are different.

Moreover, if the heating amount is controlled by changing the current-carrying voltage of the thermal head, a current-carrying voltage table is created similarly to the current-carrying table, and a voltage offset value is provided which reduces the current-carrying voltage in such a manner as to reduce the current-carrying voltage with a decreasing width of the stamp face material. Moreover, the voltage offset value may not be a subtraction of the fixed value but may be obtained by multiplying the current-carrying voltage by a fixed ratio as in the current-carrying table.

<<Trigger to Apply Offset>>

In the description up to this point, the sensor 3 reads the notch 22*a* provided to the stamp face material holder 20. The control unit 2 acquires the width of the stamp face material 21 (the length of the stamp face material in the arrangement direction of the heating elements). The offset value of the invention is applied using the width as a trigger. However, the user may specify the size of the stamp face material 21 and apply a relevant offset value based on the size.

Furthermore, it may be configured such that only when the size (especially, width) of the stamp face material 21 specified by the user by using application software of a personal computer or smartphone connected to the stamp face forming apparatus agrees with the size (especially, width) of the stamp face material 21 acquired by the stamp face forming apparatus causing the sensor 3 to read the notch 22*a* provided to the stamp face material holder 20, the offset value of the invention is applied to execute the stamp face forming process and, when they do not agree, the stamp face forming process is not executed. Consequently, if the size of the stamp face specified by the user does not agree with the inserted stamp face material holder, it is possible to avoid wasting the stamp face material holder 20 (the stamp face material 21). Moreover, this is also the case with the voltage offset value.

<<Regarding Operation and Effect of the Invention>>

The application of the invention enables a change in pressure depending on the width of the EVA, and creation of a stamp face without a crush or faint print even if the way in which the heating elements contact the EVA changes.

In other words, in a case of forming a stamp face using the stamp face material holder, the heating amount is changed (corrected) depending on the width of the EVA and accordingly it is made possible to absorb a change in pressure with a change in the width of a medium and achieve stable print quality regardless of the width of the medium.

Some embodiments of the invention have been described. However, the invention is included in the invention described in the claims and the equivalents.

What is claimed is:

1. A stamp face forming apparatus comprising:

a stamp face forming unit including a plurality of heating elements arranged in a direction along a surface on which a porous stamp face material which is able to become nonporous by heating is held, and a drive circuit for controlling heating states of the plurality of heating elements, the stamp face forming unit being configured to form a stamp face on the stamp face material while pressing the stamp face material; and a control unit configured to control the drive circuit of the stamp face forming unit to shorten a current-carrying time for the plurality of heating elements so as to reduce a heating amount per unit area to be heated of the stamp face material in the arrangement direction of the plurality of heating elements in accordance with a decrease in length of the stamp face material in the arrangement direction of the plurality of heating elements.

2. The stamp face forming apparatus according to claim 1, further comprising:

a current-carrying table for setting the current-carrying time for the plurality of heating elements, wherein the control unit applies a larger correction to the current-carrying time obtained from the current-carrying table as the length of the stamp face material in the arrangement direction of the plurality of heating elements is smaller.

3. The stamp face forming apparatus according to claim 1, wherein the control unit shortens the current-carrying time by subtracting a predetermined length of time from the current-carrying time, which is a preset value, or multiplying a predetermined ratio by the current-carrying time.

4. A stamp face forming apparatus comprising:

a stamp face forming unit including a plurality of heating elements arranged in a direction along a surface on which a porous stamp face material which is able to become nonporous by heating is held, and a drive circuit for controlling heating states of the plurality of heating elements, the stamp face forming unit being configured to form a stamp face on the stamp face material while pressing the stamp face material; and a control unit configured to control the drive circuit of the stamp face forming unit to lower a current-carrying voltage of the plurality of heating elements so as to reduce a heating amount per unit area to be heated of the stamp face material in the arrangement direction of the plurality of heating elements in accordance with a decrease in the length of the stamp face material in the arrangement direction of the plurality of heating elements.

5. The stamp face forming apparatus according to claim 4, wherein the control unit lowers the current-carrying voltage by subtracting a predetermined voltage value from the current-carrying voltage, which is a preset value, or multiplying a predetermined ratio by the current-carrying voltage.

6. The stamp face forming apparatus according to claim 4, further comprising:

a current-carrying voltage table for setting the current-carrying voltage for the plurality of heating elements, wherein the control unit applies a larger voltage correction to the current-carrying voltage obtained from the current-carrying voltage table as the length of the stamp face material in the arrangement direction of the plurality of heating elements is smaller.

7. The stamp face forming apparatus according to claim 6, wherein the voltage offset correction is performed by subtracting a predetermined voltage value from the current-carrying voltage, which is a preset value, or multiplying a predetermined ratio value by the current-carrying voltage.

8. A stamp face forming method for forming a stamp face on a porous stamp face material which is able to become nonporous by heating, the method using a stamp face forming unit having (i) a plurality of heating elements arranged in a direction along a surface on which the stamp face material is held, and (ii) a drive circuit for controlling heating states of the plurality of heating elements, the method comprising:

moving the stamp face material relatively to the stamp face forming unit while applying heat to the stamp face material to form the stamp face; and controlling the drive circuit of the stamp face forming unit to shorten a current-carrying time for the plurality of heating elements so as to reduce a heating amount per unit area to be heated of the stamp face material in the arrangement direction of the plurality of heating elements in accordance with a decrease in length of the stamp face material in the arrangement direction of the plurality of heating elements.

9. The stamp face forming method according to claim 8, further comprising:

referring to a current-carrying table for setting the current-carrying time of the plurality of heating elements, wherein in the controlling, a larger correction is applied to the current-carrying time obtained from the current-carrying table as the length of the stamp face material in the arrangement direction of the plurality of heating elements is smaller.

10. The stamp face forming method according to claim 9, wherein the correction is performed by subtracting a predetermined length of time from the current-carrying time, which is a preset value, or multiplying a predetermined ratio by the current-carrying time.

11. A stamp face forming method for forming a stamp face on a porous stamp face material which is able to become nonporous by heating, the method using a stamp face forming unit having (i) a plurality of heating elements arranged in a direction along a surface on which the stamp face material is held, and (ii) a drive circuit for controlling heating states of the plurality of heating elements, the method comprising:

moving the stamp face material relatively to the stamp face forming unit while applying heat to the stamp face material to form the stamp face; and controlling the drive circuit of the stamp forming unit to lower a current-carrying voltage of the plurality of heating elements so as to reduce a heating amount per unit area to be heated of the stamp face material in the arrangement direction of the plurality of heating elements in accordance with a decrease in length of the stamp face material in the arrangement direction of the plurality of heating elements.

12. The stamp face forming method according to claim 11, wherein the current-carrying voltage is lowered by subtracting a predetermined voltage value from the current-carrying voltage, which is a preset value, or multiplying a predetermined ratio by the current-carrying voltage.

13. The stamp face forming method according to claim 11, further comprising:

referring to a current-carrying voltage table for setting the current-carrying voltage of the plurality of heating elements, wherein in the controlling, a larger voltage correction is applied to the current-carrying voltage obtained from the current-carrying voltage table as the length of the stamp face material in the arrangement direction of the plurality of heating elements is smaller.

14. The stamp face forming method according to claim 13, wherein the correction is performed by subtracting a predetermined voltage value from the current-carrying voltage, which is a preset value, or multiplying a predetermined ratio by the current-carrying voltage.

15. A non-transitory computer-readable recording medium having a program stored thereon for controlling a computer to execute a stamp face forming process for forming a stamp face on a porous stamp face material which is able to become nonporous by heating, wherein the stamp face forming process uses a stamp face forming unit having (i) a plurality of heating elements arranged in a direction along a surface on which the stamp face material is held, and (ii) a drive circuit for controlling heating states of the plurality of heating elements, and wherein the stamp face forming process comprises:

moving the stamp face material relatively to the stamp face forming unit while applying heat to the stamp face material to form the stamp face; and controlling the drive circuit of the stamp face forming unit to shorten a current-carrying time for the plurality of heating elements so as to reduce a heating amount per unit area to be heated of the stamp face material in the arrangement direction of the plurality of heating elements in accordance with a decrease in length of the stamp face material in the arrangement direction of the plurality of heating elements.

16. The non-transitory computer-readable recording medium according to claim 15, wherein the stamp face forming process further comprises:

referring to a current-carrying table for setting the current-carrying time of the plurality of heating elements, wherein in the controlling, a larger correction is applied to the current-carrying time obtained from the current-carrying table as the length of the stamp face material in the arrangement direction of the plurality of heating elements is smaller.

17. The non-transitory computer-readable recording medium according to claim 16, wherein the correction is performed by subtracting a predetermined length of time from the current-carrying time, which is a preset value, or multiplying a predetermined ratio by the current-carrying time.

18. A non-transitory computer-readable recording medium having a program stored thereon for controlling a computer to execute a stamp face forming process for forming a stamp face on a porous stamp face material which is able to become nonporous by heating, wherein the stamp face forming process uses a stamp face forming unit having (i) a plurality of heating elements arranged in a direction along a surface on which the stamp face material is held, and (ii) a drive circuit for controlling heating states of the plurality of heating elements, and wherein the stamp face forming process comprises:

moving the stamp face material relatively to the stamp face forming unit while applying heat to the stamp face material to form the stamp face; and controlling the drive circuit of the stamp face forming unit to lower a current-carrying voltage of the plurality of heating elements so as to reduce a heating amount per unit area to be heated of the stamp face material in the arrangement direction of the plurality of heating elements in accordance with a decrease in length of the stamp face material in the arrangement direction of the plurality of heating elements.

19. The non-transitory computer-readable recording medium according to claim 18, wherein the current-carrying voltage is lowered by subtracting a predetermined voltage value from the current-carrying voltage, which is a preset value, or multiplying a predetermined ratio by the current-carrying voltage.

20. The non-transitory computer-readable recording medium according to claim 18, wherein the stamp face forming process further comprises:

referring to a current-carrying voltage table for setting the current-carrying voltage of the plurality of heating elements, wherein in the controlling, a larger voltage correction is applied to the current-carrying voltage obtained from the current-carrying voltage table as the length of the stamp face material in the arrangement direction of the plurality of heating elements is smaller.

21. The non-transitory computer-readable recording medium according to claim 20, wherein the voltage correction is performed by subtracting a predetermined voltage value from the current-carrying voltage, which is a preset value, or multiplying a predetermined ratio by the current-carrying voltage.

22. The stamp face forming apparatus according to claim 6, further comprising:

a current-carrying table for setting a current-carrying time for the plurality of heating elements, wherein the control unit applies a larger correction to the current-carrying time obtained from the current-carrying table as the length of the stamp face material in the arrangement direction of the plurality of heating elements is smaller.

23. The stamp face forming method according to claim 13, further comprising:

referring to a current-carrying table for setting a current-carrying time of the plurality of heating elements, wherein in the controlling, a larger correction is applied to the current-carrying time obtained from the current-carrying table as the length of the stamp face material in the arrangement direction of the plurality of heating elements is smaller.

24. The non-transitory computer-readable recording medium according to claim 20, wherein the stamp face forming process further comprises:

referring to a current-carrying table for setting a current-carrying time of the plurality of heating elements, wherein in the controlling, a larger correction is applied to the current-carrying time obtained from the current-carrying table as the length of the stamp face material in the arrangement direction of the plurality of heating elements is smaller.

* * * * *

UNITED STATES PATENT AND TRADEMARK OFFICE

CERTIFICATE OF CORRECTION

PATENT NO. : 9,227,449 B2
APPLICATION NO. : 14/534040
DATED : January 5, 2016
INVENTOR(S) : Hirotaka Yuno et al.

It is certified that error appears in the above-identified patent and that said Letters Patent is hereby corrected as shown below:

In the claims:

Claim 7, column 20, line 45, change “voltage offset correction” to --voltage correction--.

Signed and Sealed this
Nineteenth Day of April, 2016

Michelle K. Lee

Michelle K. Lee
*Director of the United States Patent and Trademark Office*